US006375097B1

(12) United States Patent
Matteucci

(10) Patent No.: US 6,375,097 B1
(45) Date of Patent: Apr. 23, 2002

(54) MANUAL APPARATUS FOR CLEANING A HYGIENIC VESSEL WITH WATER

(76) Inventor: Valerio Matteucci, Via Festo Avieno, 37-00136 Rome (IT)

( * ) Notice: Subject to any disclaimer, the term of this patent is extended or adjusted under 35 U.S.C. 154(b) by 0 days.

(21) Appl. No.: 09/714,116

(22) Filed: Nov. 17, 2000

(30) Foreign Application Priority Data

Nov. 18, 1999 (IT) ..... RM99U0245

(51) Int. Cl.[7] ..... B05B 7/02

(52) U.S. Cl. ..... 239/525; 239/195; 239/282; 239/288; 239/588; 4/223; 4/605

(58) Field of Search ..... 239/104, 195, 239/288, 288.3, 288.5, 282, 283, 337, 375, 525, 569, 587.1, 588; 4/222, 223, 420, 420.1, 605, 661; 134/167 R, 168 R

(56) References Cited

U.S. PATENT DOCUMENTS 3,168,984 A * 2/1965 Corning et al. ..... 239/525
4,570,855 A * 2/1986 Johnston ..... 239/195
4,670,916 A * 6/1987 Bloom ..... 4/223
4,965,894 A * 10/1990 Baus ..... 4/605
5,991,937 A * 11/1999 Safara ..... 4/903 X

* cited by examiner

*Primary Examiner*—Steven J. Ganey
(74) *Attorney, Agent, or Firm*—Browdy and Neimark P.L.L.C.

(57) ABSTRACT

A manual apparatus for cleaning a hygienic vessel with water, generally after flushing, comprising a housing; a related covering element with a base and a grip handle; a dispenser of the water jet, situated on the base and comprising an inlet union fitting, a water flow supply conduit, a shut-off valve controlled manually, by means of a lever, from a pushbutton in the covering element, a curved beak; a hose, spiral shaped, secured on one side to said dispenser and, on the other side, to a union fitting for connection to the water supply, constituting an element for supporting the housing to the wall of the bathroom.

4 Claims, 4 Drawing Sheets

MANUAL APPARATUS FOR CLEANING A HYGIENIC VESSEL WITH WATER

BACKGROUND OF THE INVENTION

The present invention relates to a manual apparatus for cleaning a hygienic vessel, commonly known as a toiled bowl, with water.

This type of apparatus is already known also from a previous application by the same Applicant. It includes a housing applied to a bathroom wall adjacent to the vessel, an element for covering said housing, a water jet dispenser provided in said covering element, a water supply hose secured, on one side, to said dispenser and, on the other side, to a union fitting for connection to the water supply line.

The advantages of this type of apparatus are evident. By completely replacing the toilet bowl "brush", it allows to clean the vessel without acting on the fecal residues by gripping and maneuvering this tool which is not hygienic and aesthetically objectionable, and without bending over the vessel itself. But abolishing the "brush" entails other implicit advantages, since it is no longer necessary to provide for its periodic cleaning, or for that of its container, and to replace it at the end of its service life.

Moreover, this type of apparatus allows some advantages of no small importance: its use before flushing reduces water consumption and, ultimately, reduces the work of personnel tasked with cleaning the sanitary facilities. The cost of the apparatus and of its installation is, on average, higher than that of the "brush", but it is still modest, whilst its insertion in the environment has a pleasant impact unlike the negative one of the "brush".

However, the known model of apparatus for cleaning a hygienic vessel with water does present some drawbacks. Its effective radius depends on the length of the water supply hose. This length is conditioned by the ability of the housing the receive the hose, since the hose, at rest, has the handing profile of a segment of rope suspended by its approached ends, i.e. it forms a catenary. Hence, a reduction in the size of a housing compartment entails a limitation of the length of the hose and, therefore, of the effective radius of the water cleaning apparatus, which therefore needs to be installed in close proximity to the hygienic vessel. This constitutes a constraint in the design of the bathroom space.

Moreover, the known model of apparatus provides a version for installation in new toilet bowls, whereby the housing of the apparatus is recessed in the wall of the bathroom, and a version for installation in previously installed toiled bowls. This entails the need for different versions, driving production and marketing costs upwards for different models and spare parts.

In addition, the known model of apparatus requires, in new facilities, to effect a recess in the masonry and to mount a water outlet with obligatory measurements.

Furthermore, the known model of apparatus requires the presence of a pressure reducer in order to allow the adoption of a highly flexible water supply hose, to allow its return into the housing by the effect of gravity.

Additionally, the known model of apparatus provides for the passage of water through the grip, obligating the type of design and construction and, no less important, giving an unpleasant sensation of cold to the hand when in use.

SUMMARY OF THE INVENTION

To overcome the aforementioned drawbacks, the present invention provides a manual apparatus for cleaning a toilet bowl with water, of the type including a housing applied to a bathroom wall adjacent to the vessel, an element for covering said housing, a dispenser of a water jet provided in said covering element, a water supply hose secured on one side to said dispenser and, on the other side, to a union fitting for connection to the water supply line, which, from the general point of view, is characterized in that said covering element presents inferiorly a base and superiorly a grip handle for lifting and maneuvering the waterjet dispenser;

said water jet dispenser, situated on said base of the covering element, comprises an inlet union fitting passing through the base of the covering element, a water flow supply conduit, a valve for shutting off said water flow provided in said supply conduit and controlled manually, by means of a lever, from a pushbutton situated anteriorly in said covering element, a curved beak oriented downwards and projecting with its free end through an opening obtained in said base of the covering element;

said hose, connected at one end to said inlet union fitting and at the other end to the union fitting connecting to the water supply line, is shaped as a spiral;

said connecting union fitting, comprising a closure tap, constitutes an element supporting said housing to the bathroom wall.

Thanks to the adoption of a spiral shaped hose between the union fitting connecting to the water supply line and the dispenser, the latter has a significant effective radius, with a reduced size of its housing. Several advantages stem therefrom: it is easier to determine the mounting position of the apparatus in the bathroom, the dimensions are reduced and hence more easily accommodated even in small spaces as are those of bathrooms the possibility to mount is at such a height from the floor as to allow to grip the dispenser without bending and without creating areas that are difficult or annoying to clean with the floor; reduced usage of raw materials and thus fabrication costs; reduced weights and size, with a consequent lesser impact also on transportation costs.

The apparatus according to the present invention is substantially unified for installation both in old and in new facilities, as shall become more readily apparent hereafter, varying only in the way it is attached to the wall. Thus, savings shall be obtained both in the production of the apparatus, and in the setting up of the warehouse and of the spare parts.

The apparatus according to the invention requires solely a water outlet flush with the wall, such as a tap for washing machine or rubber holder. The apparatus can therefore be dismantled and reused in a different toilet bowl or in the same one after any renovations.

The apparatus according to the invention allows to connect the dispenser directly to the water supply line thanks to the adoption of a spiraling hose able to withstand far greater pressures than those of the aqueduct, which obviates the need for a pressure reducer. Compatibility with a high pressure makes use of the apparatus according to the invention more effective. The spiraling conformation of the hose and the elasticity of the material allow for the easy return of the hose into its housing. The elastic spiral also serves as a shock absorber against water hammering, benefiting the entire plumbing system. Thus, the likelihood of failures is reduced, also thanks to a reduction in the number of spares, mounting simplicity is increased and production, packaging and transportation costs are reduced.

In the apparatus according to the invention, water does not pass through the grip: design and construction constraints are reduced and usage is made more convenient and comfortable.

BRIEF DESCRIPTION OF THE DRAWINGS

Further features and advantages of the invention shall become more readily apparent from its detailed description that follows, illustrated in the accompanying drawings, in which.

DESCRIPTION OF THE PREFERRED EMBODIMENTS

Figure 1:
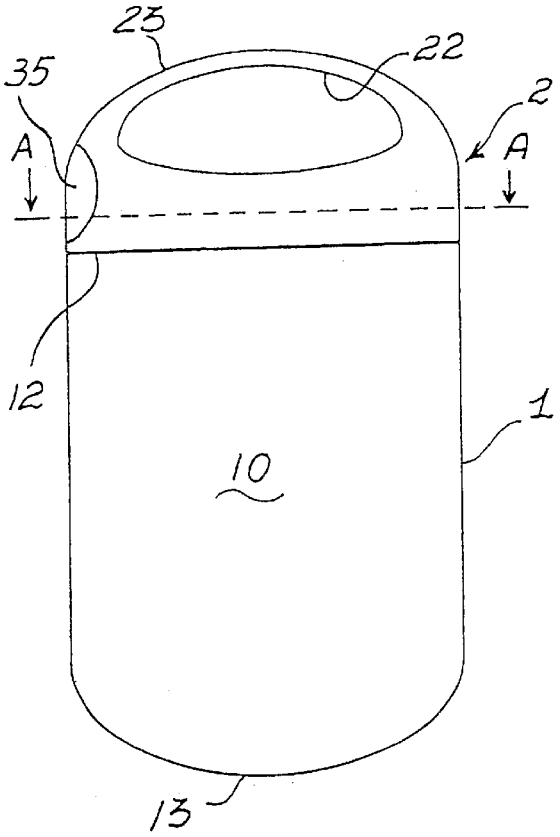
FIG. 1 is a front view of the cleaning apparatus according to the present invention.
Figure 2:
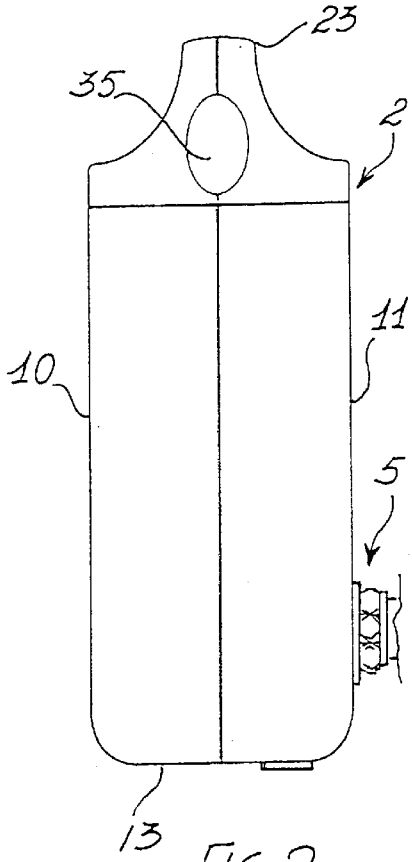
FIG. 2 is a lateral view of the cleaning apparatus of FIG. 1.

Referring initially to FIGS. 1 and 2, the manual apparatus for water cleaning according to the invention comprises a flattened housing 1, for instance with elliptical section, obtained with two semi-shells made of plastic material, anterior and posterior, 10 and 11, joined peripherally. In the posterior semi-shell 11, inferiorly, is provided a union fitting 5 for connection with the water supply line, which also constitutes an element for supporting the housing in projecting fashion from the wall. The housing 1 has a closed bottom 13, preferably shaped according to a convex surface. Superiorly, the housing 1 has an opening 12 able to be closed with a conforming covering element 2.

The covering element 2 inferiorly presents a base 20 (FIGS. 4 and 5) and superiorly a vault 21, also obtained in two halves and provided with a window 22 to form a grip handle 23. Laterally, in the covering element 2 is provided an activating pushbutton 35, as illustrated hereafter.

Figure 3:
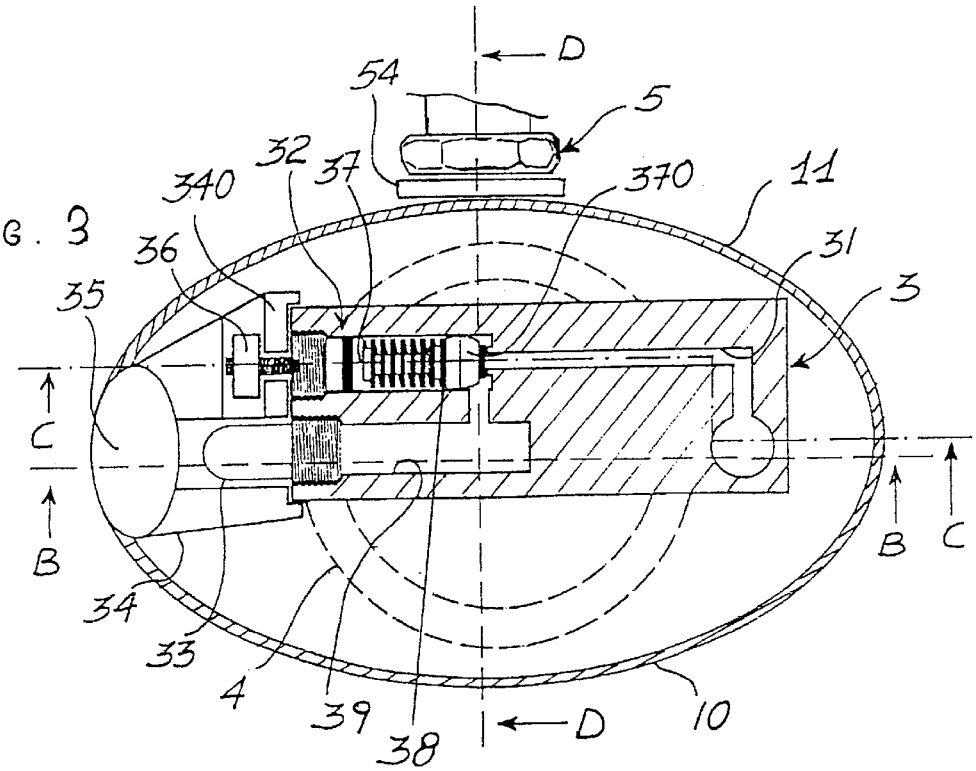
FIG. 3 is a section obtained according to the line A—A of FIG. 1.
Figure 4:
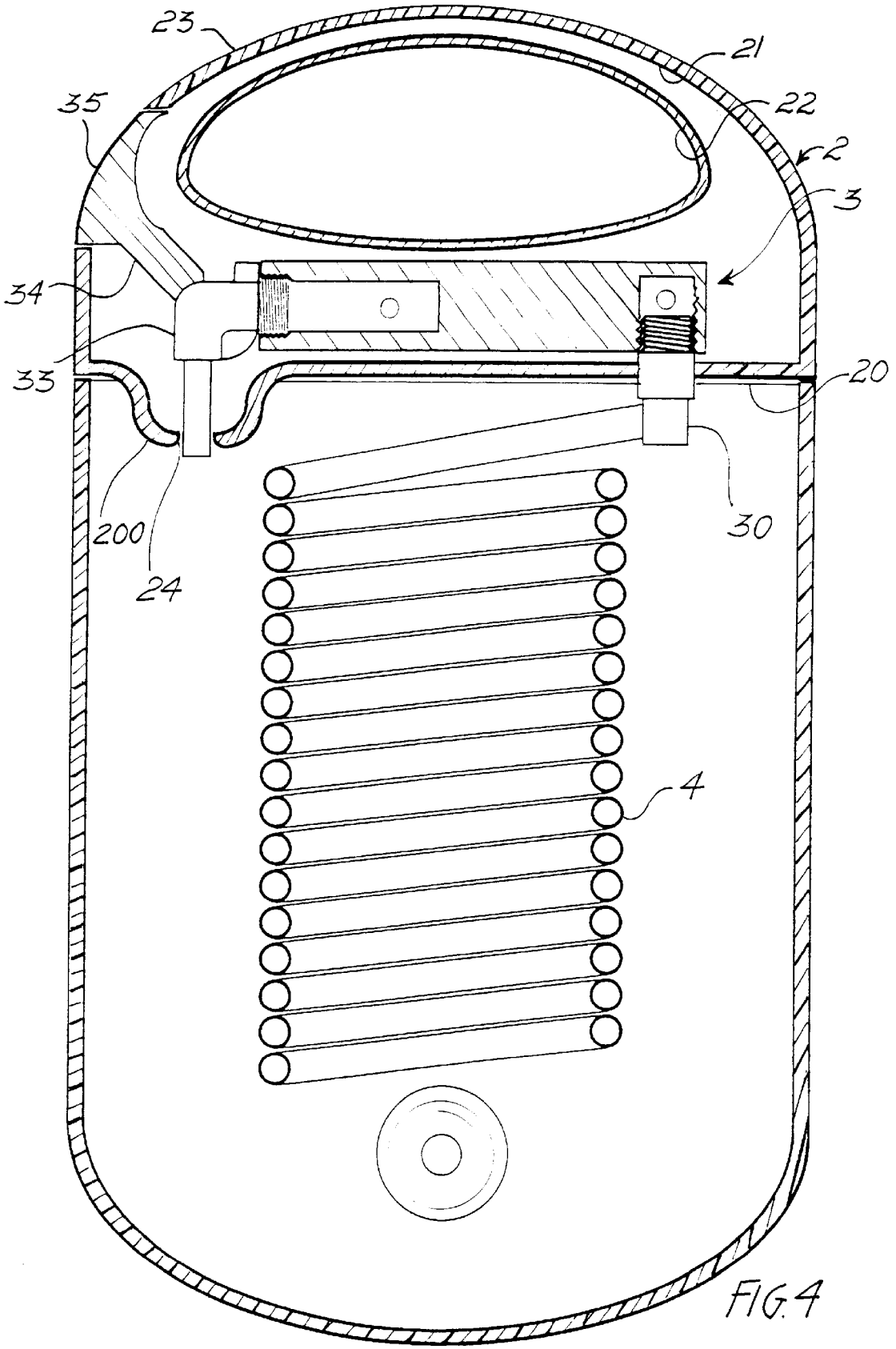
FIG. 4 is a section obtained according to the line B—B of FIG. 3.
Figure 5:
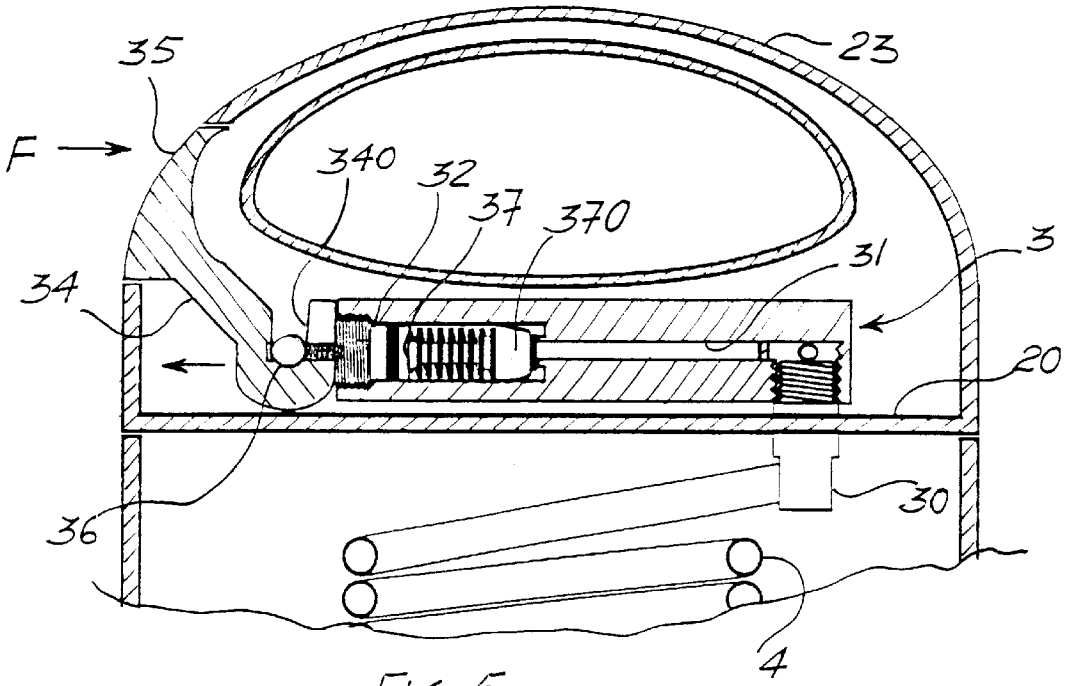
FIG. 5 is a section obtained according to the line C—C of FIG. 3.

As shown in FIGS. 3 through 5, inside the covering element 2 is located a water jet dispenser 3, connected by means of a hose 4 to the connection fitting 5. The dispenser 3 is situated in the base 20 of the covering element 2 and comprises an inlet fitting 30 passing through said base 20, a conduit 31 for the supply of a water flow, a valve 32 for shutting off said water flow and a beak 33. As better shown in FIG. 5, which is a section obtained according to the broken line C—C of FIG. 3, the shut off valve 32 is provided in the supply conduit 31 and controlled manually, through a lever 34, from the pushbutton 35. The lever 34 has a fork 340 oriented upwards which holds a transverse pivot rod 36 connected to a piston 37, ending with a shutter 370. The piston 37, movable against the action of a counter spring 38, serves to close the supply conduit 31 in its outlet segment 39 ending in the beak 33. As better shown in FIG. 4, which is a section obtained according to the line B—B of FIG. 3, the beak 33 is curved downward and projects with its free end through an opening 24 obtained in the base 20 of the covering element 2. The base 20 is suitably shaped in its portion 200 to adapt to the beak 33. As stated above, the hose 4, connected at one end to the inlet fitting and at the other end to the fitting 5 connecting to the water supply line, is spiral shaped, preferably made of rilsan (trade name), and able to withstand high pressures.

Figure 6:
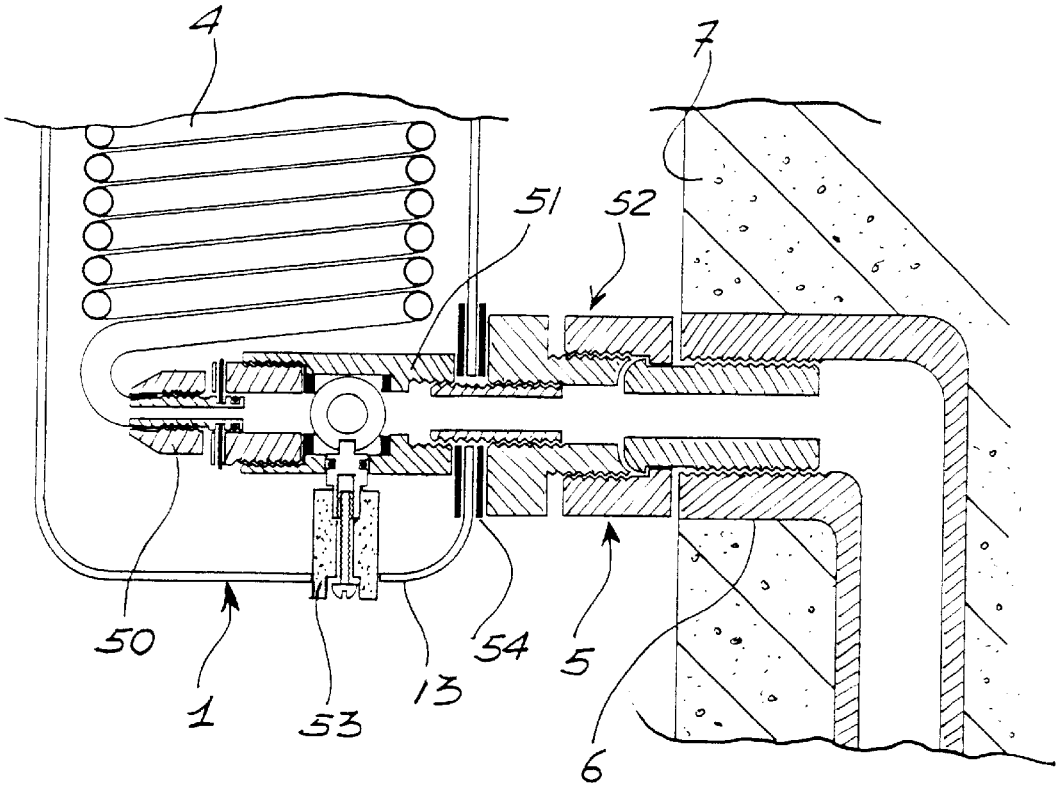
FIG. 6 is a partial section obtained according to the line D—D of FIG. 3 in the lower part of the cleaning apparatus according to the invention with a first example of wall mounted support.
Figure 7:
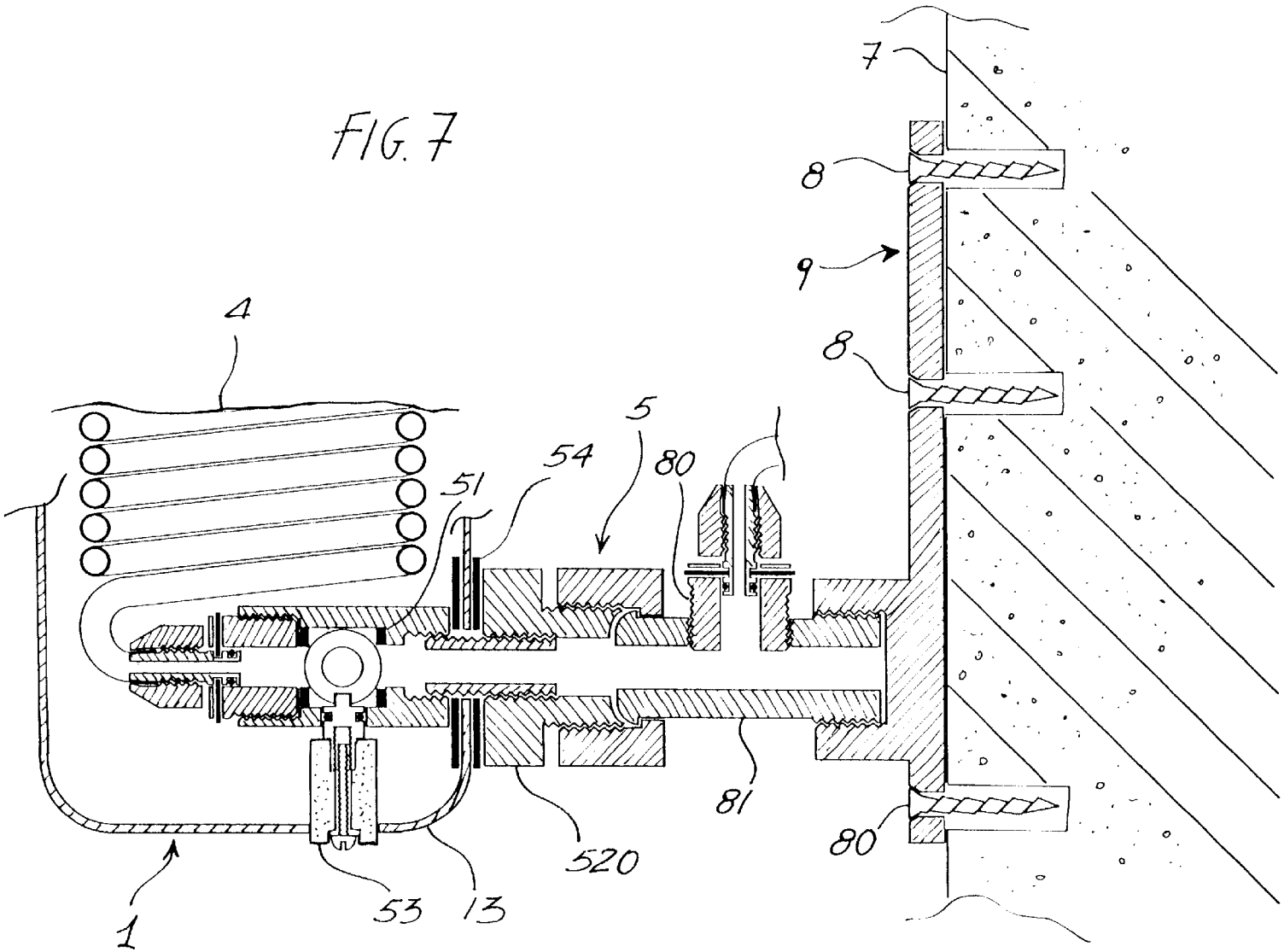
FIG. 7 is a partial section obtained according to the line D—D of FIG. 3 in the lower part of the cleaning apparatus according to the invention with a second example of wall mounted support.

As shown in FIGS. 6 and 7, the connection fitting 5 connects the apparatus according to the present invention to the water supply line to supply water to the cleaning water jet dispenser. In both embodiments illustrated in FIGS. 6 and 7, the connection fitting 5 comprises an element 50 for gripping the end of the hose 4, a tap 51 and a ball joint 52, 520. The tap 51, for instance with ball shutter, is arranged in such a way that its control lever 53 is accessible only from outside the housing 1, because it passes through its bottom 13. The wall of the housing is held between the tap 51 and the ball joint 52, 520 by means of sealing gaskets 54.

In the example shown in FIG. 6 the ball joint 52 is connected directly with threaded coupling to a water outlet 6, substantially elbow-shaped, appropriately provided in the wall 7, for instance, in a newly constructed bathroom.

In the example shown in FIG. 7 the ball joint 520, connected with threaded coupling of its pipe segment 81 on a support plate 9, fastened with screw anchors and screws 8 to a bathroom wall 7 comprising a closure tap, constitutes an element for supporting said housing in such a manner that it projects from the wall 7 of the bathroom. On the pipe segment 81 of the ball joint 520 is provided a T union fitting 80 for supplying water from a water outlet located distant from the location of the apparatus according to the invention.

In operation, the covering element 2 is lifted from the opening on the housing 1 and approached to the hygienic vessel to be washed. Acting with a force directed according to the arrow F (FIG. 5) on the pushbutton 35 and, through the lever 34 on the fork 340 (which moves according to the arrow G), on the shutter 37, the supply conduit 31 is open in its final segment 39 which leads to the exit of the water jet through the beak 33. The jet oriented on the hygienic vessel easily removes any fecal residues without causing any annoyance and inconvenience for the person performing the operation.

The invention thus conceived can be subject to numerous modifications and variations, without thereby departing from the scope of the inventive concept.

What is claimed is:

1. A manual apparatus for cleaning a hygienic vessel with water, comprising a housing adapted to be applied to a wall of a bathroom adjacent to the vessel, a covering element engaged to said housing, a dispenser of a water jet provided in said covering element, a hose for supplying water secured on one side to said dispenser and, on the other side, to a union fitting connecting to the water supply line, wherein said covering element inferiorly presents a base and superiorly a grip handle for lifting from the housing and maneuvering the water jet dispenser;

said water jet dispenser, situated on said base of the covering element, comprises an inlet fitting passing through the base of the covering element, a conduit for supplying a water flow, a valve for shutting off said water flow provided in said supply conduit and controlled manually, through a lever, from a pushbutton situated anteriorly in said covering element, a curved beak oriented downwards and projecting with its free end through an opening obtained in said-base of the covering element;

said hose, connected at one end to said inlet fitting and at the other end to the union fitting for connection to the water supply line, is shaped as a spiral;

said union fitting, comprising a closure tap, constitutes an element for supporting said housing to the wall of the bathroom.

2. An apparatus as claimed in claim 1, wherein said spiral shaped hose is made of rilsan (trade name).

3. An apparatus as claimed in claim 1, wherein said union fitting comprises a ball joint joined by means of threaded coupling to an elbow of the water supply line passing through the wall of the bathroom.

4. An apparatus as claimed in claim 1, wherein said union fitting comprises a ball joint provided with a pipe segment joined by means of threaded coupling to a plate for fastening to the bathroom wall; said pipe segment presenting a T fitting for connection to the water supply line.

* * * * *